US006056516A

United States Patent [19]

Schönfeld et al.

[11] Patent Number: 6,056,516

[45] Date of Patent: May 2, 2000

[54] COMPRESSOR INSTALLATION HAVING A CONTROL VALVE ARRANGEMENT FOR INDEPENDENTLY SWITCHING COMPRESSION CHAMBERS BETWEEN DELIVERY PARTIAL DELIVERY AND IDLE OPERATION

[75] Inventors: Karl Heinrich Schönfeld, Seelze; Folkhard Hölzel, Lauenhagen, both of Germany

[73] Assignee: WABCO Standard GmbH, Hannover, Germany

[21] Appl. No.: 08/950,777

[22] Filed: Oct. 15, 1997

[30] Foreign Application Priority Data

Oct. 11, 1997 [DE] Germany ..... 197 45 118

[51] Int. Cl.[7] ..... F04B 49/00

[52] U.S. Cl. ..... 417/286; 417/307; 417/298

[58] Field of Search ..... 417/298, 306, 417/307, 440, 286, 446

[56] References Cited

U.S. PATENT DOCUMENTS

| | | | |
|---|---|---|---|
| 4,209,984 | 7/1980 | Kittle et al. | 60/328 |
| 4,432,698 | 2/1984 | Shirakuma et al. | 417/27 |
| 4,505,122 | 3/1985 | Inomata | 62/133 |
| 4,519,750 | 5/1985 | Kurahashi et al. | 417/270 |
| 4,938,666 | 7/1990 | DeSantis et al. | 417/295 |
| 5,101,857 | 4/1992 | Heger et al. | 137/599 |
| 5,211,544 | 5/1993 | Klumpp et al. | 417/286 |
| 5,295,795 | 3/1994 | Yasuda et al. | 417/213 |
| 5,456,581 | 10/1995 | Jokela et al. | 417/282 |
| 5,503,537 | 4/1996 | Schlossarczyk et al. | 417/296 |
| 5,813,841 | 9/1998 | Sturman | 417/446 |

FOREIGN PATENT DOCUMENTS

| | | |
|---|---|---|
| 25 08 941 A1 | 9/1976 | Germany . |
| 41 05 593 A1 | 9/1991 | Germany . |
| WO 92/14944 | 9/1992 | WIPO . |

*Primary Examiner*—Charles G. Freay
*Assistant Examiner*—Robert Z. Evora
*Attorney, Agent, or Firm*—Proskauer Rose LLP

[57] ABSTRACT

An installation for the production of pressure has three operating states corresponding to a delivery operation, an idle operation, and a partial delivery operation. The installation contains at least two compression chambers in at least one compressor, each chamber being assigned at least one switchable inlet valve. In the delivery operation, the switchable inlet valves act as check-valves that allow pressure medium to flow into their respective compression chambers. Each compression chamber also contains at least one outlet check valve through which compressed pressure medium flows out to a pressure consuming system in the delivery operation. Each switchable inlet valve also has an idling position that allows pressure medium to flow into the applicable compression chamber and back out again without being substantially compressed. In the idle operation of the installation, each switchable inlet valve switches to its idling position. In the partial delivery operation, one of the switchable inlet valves independently switches to its idling position, while the other inlet valve remains in its rest position, thus resulting in only partial delivery of the pressure medium to the pressure consuming system.

21 Claims, 2 Drawing Sheets

COMPRESSOR INSTALLATION HAVING A CONTROL VALVE ARRANGEMENT FOR INDEPENDENTLY SWITCHING COMPRESSION CHAMBERS BETWEEN DELIVERY PARTIAL DELIVERY AND IDLE OPERATION

BACKGROUND OF THE INVENTION

The present invention relates to an installation for the production of pressure with two or more compression chambers. The compression chambers can be arranged in one or more compressors. Each of the compression chambers has one or more switchable inlet valve(s) which can be switched over by means of a switching device from a rest position to an idling position, thereby switching the installation over from a delivery operation to an idling operation.

An installation for the production of pressure of this type with two compression chambers is known from DE 43 21 013 A1 (corresponding to U.S. Pat. No. 5,503,537), and in particular from FIG. 2 therein. In the installation described therein, the compression chambers are located in a two-cylinder compressor. The switchable inlet valves described therein are constructed with swiveling or sliding lamellae that are known from DE 39 04 172 A1 (corresponding to U.S. Pat. No. 5,101,857. In the rest position of the inlet valves, the valve lamellae assume a position in which the inlet valves act as check valves that are open only in the direction of the applicable compression chamber. In the idle position of the inlet valves, the valve lamellae are swiveled or displaced by means of switching devices in such mariner that the inlet valves are always open. As a result, no pressures can build up in the compression chambers, and the installation for the production of pressure switches over to an idle operation wherein there is no delivery of the pressure medium to a pressure consuming system.

The installation for the production of pressure of the type mentioned initially is used in cases where the pressure medium requirement cannot be met by a single-cylinder compressor. Among these cases, there are some where the capacity of the installation for the production of pressure cannot be utilized throughout the entire operating range of the installation for the production of pressure and/or of the pressure consuming system that the latter supplies. Such a case occurs, for example, when the at least one compressor of the installation for the production of pressure is operated at varying rotational speeds, such as, e.g., in automotive technology applications. It can occur then that at higher speeds, the delivery of the installation for the production of pressure cannot be absorbed or processed by the pressure consuming system or by its individual elements. The capacity of a drying system, for example, may be insufficient for this delivery.

It is, therefore, the object of the present invention to adapt an installation for the production of pressure of the type mentioned initially through simple means to the absorption capacity of the downstream pressure consuming system.

SUMMARY OF THE INVENTION

In accordance with the present invention, an installation for the production of pressure receives a pressure medium through a suction line. In its normal delivery operation, the installation compresses the pressure medium and sends it through an outlet line to a pressure consuming system. The installation also has a partial delivery operation that saves power while producing a reduced flow of the compressed pressure medium that is sufficient under certain conditions.

Finally, the installation has an idle operation that reduces the power consumption even more but produces no output flow of the compressed pressure medium.

The installation comprises at least one compressor containing at least two compressor cylinders, and associated valves and lines. Each compressor cylinder consists, in a known manner, of a housing cylinder and a piston that can be displaced therein. The volume enclosed between a piston and its housing cylinder is known as a compression chamber. Pressure medium flows from the suction line into the compression chamber through at least one inlet valve as the motion of the piston increases the volume of the chamber. In normal delivery operation, an inlet valve acts as a check valve, which means that the pressure medium does not return to the suction line when the pressure in the chamber rises above the pressure in the suction line. Instead, as the motion of the piston reduces the volume of the chamber again, the pressure in the compression chamber rises until an outlet check valve opens and the pressure medium is delivered to the pressure consuming system.

The at least one inlet valve at each compression chamber is a switchable inlet valve. In the delivery operation, the switchable inlet valves continue to act as check valves that allow pressure medium to flow into their respective compression chambers. However, each switchable inlet valve also has an open position that allows pressure medium to flow back out of the applicable compression chamber and into the suction line without being substantially compressed. In the idle operation of the installation, at least one switchable inlet valve of each compression chamber switches to its open position and the flow of compressed pressure medium into the pressure consuming system ceases.

In the partial delivery operation of the installation, the switchable inlet valve or at least one of the switchable inlet valves of one of the selected compression chambers independently switches to its open position. The remaining switchable inlet valve at the other compression chamber remains in its check valve position allowing that chamber to continue compressing pressure medium. The switchable inlet valves may be actuated by a control logic.

In a preferred embodiment the control logic comprises two switch valves that control the switchable inlet valves at the compression chambers. The control logic receives pressure medium from at least one location of the pressure consuming system. In normal delivery operation, the switch valves keep their associated inlet valves in their check-valve positions until a predetermined pressure is reached in the pressure consuming system. When the predetermined pressure is reached, the switch valves switch their associated inlet valves to their open positions and the installation performs its idle operation. However, at least one of the switch valves can accept a partial load input signal that causes it to idle its compression chamber independently of the other compression chamber. The installation then performs a partial delivery operation.

The organization and operation of this invention will be understood from a consideration of a detailed description of the illustrative embodiments which follow, when taken in conjunction with the accompanying drawings. In the drawings, similar components are denoted by the same reference numerals.

DETAILED DESCRIPTION OF THE INVENTION

Figure 1:
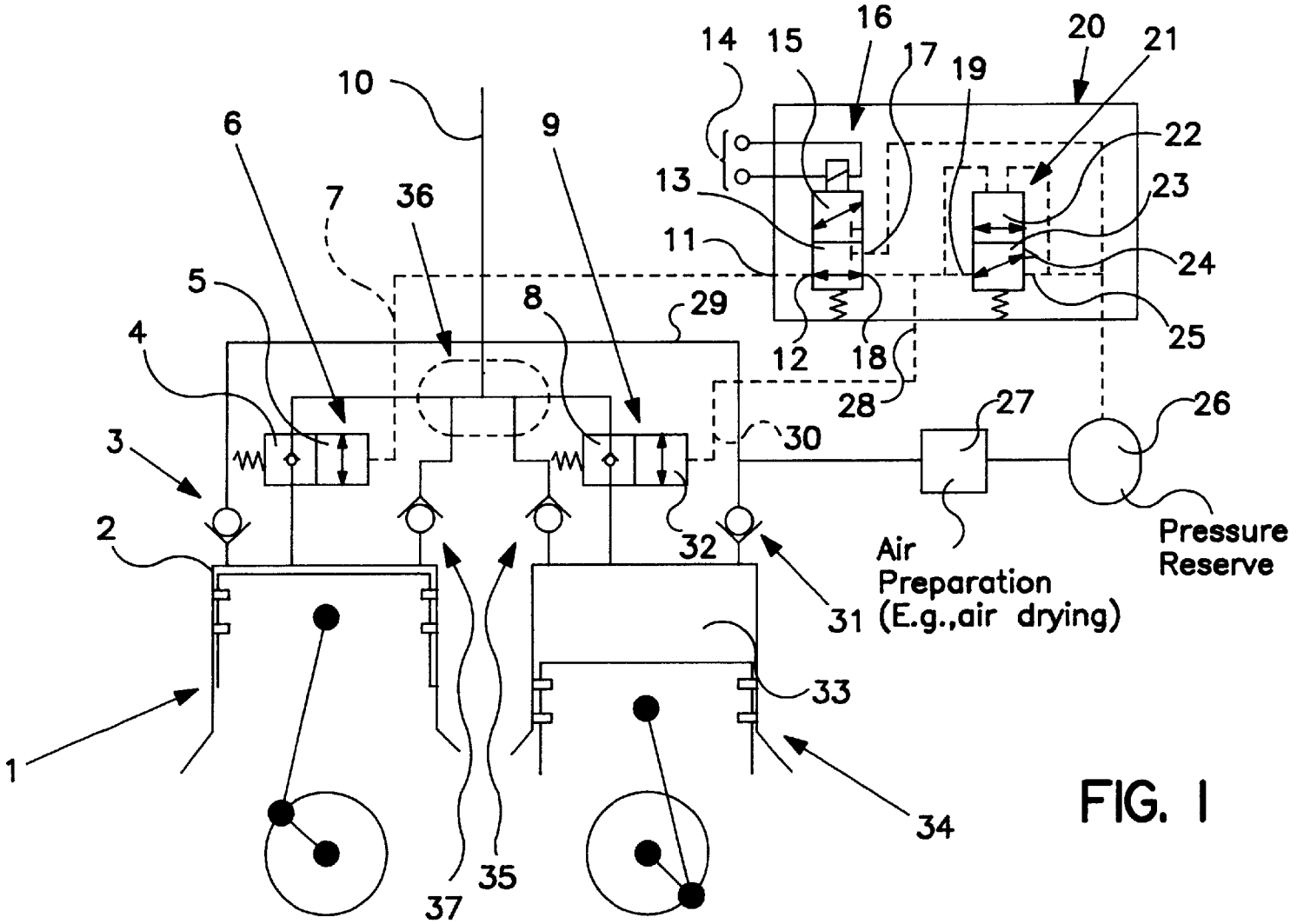
FIG. 1 is a schematic diagram of an installation for the production of pressure according to the invention with switchable inlet valves that are switched by outputs of a control logic.

The installation for the production of pressure shown in FIG. 1 is designed to use air as the pressure medium. In case of another pressure medium, the installation will work in a closed circuit in which the pressure relief outlet mentioned below leads to a collection container under atmospheric pressure.

The installation for the production of pressure contains two compression chambers (2, 33) in compressor cylinders (1, 34) that consist, respectively, in a known manner of a housing cylinder and a piston that can be displaced therein. The cylinders (1, 34) can be united in a known manner into a two-cylinder compressor or can be assigned to separate compressors.

Each compression chamber (2 or 33) is assigned an inlet valve (6 or 9) and an outlet valve (3 or 31). The compression chambers (2 or 33) can be connected via the inlet valves (6 or 9) to a suction line (10). The compression chambers (2 or 33) can be connected via the outlet valves (3, 31) to an outlet line (29). The outlet valves (3, 31) act in a known manner as check valves opening in the direction from the corresponding compression chambers (2 or 33) to the outlet line (29).

The suction line (10) opens directly or via one or several intermediate elements into the atmosphere. Intermediate elements may be e.g., air filters, noise dampers and, in particular in automotive technology, a suction channel and/or a charger (supercharger, turbocharger) of the driving engine.

The outlet line (29) leads to a pressure consuming system (26, 27). Of the latter, an air preparation device (27) and, standing in for one or several pressure consumers (e.g., operating cylinders), a pressure reserve (26) are shown. The air preparation device (27) consists, in a known manner, of devices for air cleaning, air drying and, furthermore, of safety, locking, protection and monitoring devices, insofar as these are required for the particular application.

Each of the inlet valves (6, 9) has a rest position (4 or 8) and a switching device. When the switching devices are not actuated, the inlet valves (6, 9) automatically, e.g., through spring return, assume their rest positions (4 and 8). In their rest positions the inlet valves (6, 9) act, as usually, as check valves opening in the direction from the suction line (10) to the corresponding compression chamber (2 or 33). When the switching devices are actuated, they switch the inlet valves (6, 9) to their respective idling positions (5 and 32) and hold them in that position during the actuated time. In the idling positions (5 and 32), the inlet valves (6, 9) are always open in both directions.

In normal (delivery) operation of the installation for the production of pressure, the inlet valves (6, 9) are in their rest positions (4 and 8). In this mode, the pistons suck air to be compressed through the suction line (10) and the inlet valves (6, 9) into the compression chambers (2, 33). After compression to the pressure prevailing in the pressure consuming system, this air is pushed through the outlet valves (3, 31) into the outlet line (29) and through the latter into the pressure consuming system (26, 27)

The switch-over of the installation for the production of pressure from delivery operation into idle operation is triggered by actuating the switching devices of the inlet valves (6, 9). In this mode, a volume of air approximately equal to the maximum volume of the corresponding associated compression chamber (2 or 33) is pushed back and forth between the latter and the suction line (10) through the open inlet valves (6, 9). This air is not substantially compressed and therefore is not pushed through the outlet valves (3, 31).

It is, however, also possible to actuate the switching device of only one inlet valve (6 or 9) and thereby to switch only the latter, independently of the other inlet valve (6 or 9), into its idling position (5 or 32). In this manner, the installation for the production of pressure can also be operated in a partial delivery operation with reduced delivery. Here it is possible for the same inlet valve (6 or 9) to be always switched independently or for both inlet valves (6, 9) to be switched alternately and independently. When the compression chambers are of identical size, and for a given rotational compressor speed, the reduced delivery is approximately one-half the delivery in normal delivery operation.

The switching devices of the inlet valves (6, 9) can be of any suitable design, e.g., electrical or pressure dependent devices.

The valves mentioned above as well as the valves mentioned below are shown with basic and functional symbols according to the international standard ISO 1219. Valves built and designed in this manner are known to persons schooled in the art and can be produced by them without difficulty. The manner of drawing them according to ISO 1219 also indicates that the switching devices of the inlet valves (6, 9) are operated by pressure. An example of a suitable inlet valve is the inlet lamella valve with the swiveling or sliding valve lamellae according to the previously mentioned U.S. Pat. No. 5,101,857. The outlet lamella valve described therein is also suitable for use as the outlet valves (3, 31).

The actuation of the switching devices of the inlet valves (6, 9), and thereby the control of the installation for the production of pressure, can be effected in any known manner. It is, for example, practical to use a control logic that transmits actuating signals to the switching devices of the inlet valves (6, 9) via signal lines. The types of actuating signals and signal lines must of course be adapted to the type of switching devices of the inlet valves (6, 9), i.e., electrically or pressure dependent devices.

An example of a control logic suitable for controlling inlet valves with pressure dependent switching devices is shown schematically by reference number 20 in FIG. 1.

The control logic (20) has two outputs (11, 28). The first output (28) is connected via a signal line (30) to the switching device of the inlet valve (9) of the one compression chamber (33). The second output (11) is connected via a signal line (7) to the switching device of the inlet valve (6) of the other compression chamber (2). Depending on the type of switching devices of the inlet valves (6, 9), the outputs (11, 28) or the signal lines (7, 30) are made in the form of pressure connections or lines.

The control logic (20) is furthermore provided with an input which is not designated in further detail and which is connected to the pressure reserve (26) of the pressure consuming system (26, 27). In a manner not shown, the input of the control logic (20) can also be connected with identical effect to another location of the pressure consuming system (26, 27) carrying pressure.

The control logic (20) illustrated in FIG. 1 contains a first switch valve (21) with a pressure dependent switching device and a second switch valve (16) with an electrical switching device. For actuating signals to the latter switching device, the control logic (20) is provided with electrical connections (14). The control logic (20) can be a compact, integrated component group. However, it may also be designed in a dispersed construction form with individual valves.

The first (pressure dependent) switch valve (21) has an input (25), a work output (19) and a pressure relief output (24). The input (25) serves as the input of the control logic (20), and is connected to the pressure reserve (26). The work output (19) is connected to the first output (28) of the control logic (20), and the pressure relief output (24) lets out into the atmosphere because air is the pressure medium. According to FIG. 1, the switching device of the first switch valve (21) is connected to the input (25), which is connected to the input of the control logic (20), and thereby to the pressure reserve (26). This switching device is designed so that it actuates the first switch valve (21) when the pressure in the pressure reserve (26) has reached a desired value (the switch-off pressure). This actuation continues until that pressure has dropped to a lower limit value (the switch-on value).

When its switching device is not actuated, the first switch valve (21) automatically, e.g., under spring return force, assumes a closed position (23). This closes the input (25) and connects the work output (19), and thereby the first output (28) of the control logic (20), to the pressure relief output (24). Upon actuation, the switching device switches the first switch valve (21) into an open position (22). In this position, the work output (19) of the first switch valve (21), and thereby the first output (28) of the control logic (20) as well, are connected to the input (25).

Valves with the characteristics of the first switch valve (21) are known and used in automotive technology, wherein they are referred to as "governors."

The second switch valve (16) has two inputs (17, 18) and a work output (12). The work output (12) is connected to the second output (11) of the control logic (20). At its first input (18), the second switch valve (16) is connected to the work output (19) of the first switch valve (21). At its second input (17), the second switch valve (16) is connected to the input of the control logic (20) and thereby to the pressure reserve (26). Alternatively, the second input (17) may be connected to a different pressure supply, but the effect remains the same.

The switching device of the second switch valve (16) is actuated through electrical connections (14). When its switching device is not actuated, the second switch valve (16) automatically, e.g., under spring return force, assumes a first open position (13). This closes the second input (17) and connects the work output (12), and thereby the second output (11) of the control logic (20), to the first input (18) of the second switch valve (16) and thereby also to the work output (19) of the first switch valve (21). Upon actuation, the switching device of the second switch valve (16) switches over to a second open position (15). This closes the first input (18) and connects the work output (12), and thereby the second output (11) of the control logic (20), to the second input (17) of the second switch valve (16). The second input (17) is connected, as mentioned, via the input of the control logic (20) to the pressure reserve (26).

In normal delivery operation of the installation for the production of pressure, the control logic (20) assumes a first operating state in which the first switch valve (21) is in its closed position (23) and the second switch valve (16) is in its first open position (13). In this operating state, the control logic (20) emits no pressure and therefore no signal at any of its outputs (11, 28).

When the pressure in the pressure reserve (26) now reaches the desired value, the switching device of the first switch valve (21) switches the latter to its open position (22), while the second switch valve (16) remains in its first open position (13). Pressure medium from the pressure reserve (26) now flows through the first switch valve (21) and, in addition, through the second switch valve (16) to the outputs (11, 28) of the control logic (20). The pressure medium continues via the signal lines (7, 30) to the switching (devices of the inlet valves (6, 9). Both inlet valves (6 and 9) are thereby switched to their idling positions (5 and 32), whereupon the installation for the production of pressure passes into idle operation. In this second operating state, the control logic (20) transmits pressure or pressures at its two outputs (11, 28) and thereby, generally speaking, an idling signal.

Let it now be assumed that the switching device of the second switch valve (16) is actuated during normal delivery operation while the first switch valve (21) remains in its closed position (23). Switch valve (16) is then switched to its second open position (15), in which the pressure medium is able to flow from the pressure reserve (26) through the second switch valve (16) to its work output (12). The pressure medium continues via the second output (11) of the control logic (20) as well as the signal line (7) to the switching device of the inlet valve (6) of the compression chamber (2). This switching device then switches the inlet valve (6) to its idling position (5) whereupon the compression chamber (2) no longer participates in delivery. The installation for the production of pressure now runs in partial delivery operation with reduced delivery. In this third operating state, the pressure transmitted at the second output (11) of the control logic (20) is generally referred to as a partial load signal.

When the installation for the production of pressure is in partial delivery operation and the pressure in the pressure reserve (26) reaches the desired value, the switching device of the first switch valve (21) switches it to its open position (22), while the second switch valve (16) remains in its second open position (15). The control logic (20) then transmits pressure to its first output (28) in addition to the pressure at its second output (11). Upon receiving this pressure, the switching device of the inlet valve (9) switches the latter also to its idling position (32) so that the installation for the production of pressure goes from partial delivery operator to idling operation. Generally speaking, it can be said that the control logic (20) transmits the idling signal at its first output (28) and the partial load signal at its second output (11) in this fourth operating state.

The actuation of the switching device of the second switch valve (16), and thereby the change-over of the installation for the production of pressure to partial delivery operation, can be effected by any suitable electrical method, e.g., by means of a manual switch, and according to any suitable criteria. The actuation is effected often by means of a suitably designed control device in accordance with one or several criteria of the installation for the production of pressure and/or of the pressure consuming system. The actuation could take place, e.g., when the rotational speed of the compressor reaches a predetermined limit value. Instead of the rotational speed of the compressor, or in addition to same, the occurrence of an unacceptably high dynamic pressure at a location of the pressure consuming system (26, 27) could actuate the switching device of the second switch valve (16). Other criteria that the control device could use for the above-mentioned actuation, either individually or in combinations, are excessive air moisture at the output of the air preparation device (27) and excessive pressure in the suction line (10) (e.g., in case of a drive engine with a charger).

The switching devices of the first switch valve and of the second switch valve can also be actuated in a manner different from that described above. For example, the switching device of the second switch valve could be pressure dependent, and/or the switching device of the first switch valve could be electrical. In the latter case, the pressure of the pressure reserve (26) can be monitored by means of a pressure switch or a pressure sensor which actuates the switching device of the first switch valve directly or via a suitable control circuit.

Figure 2:
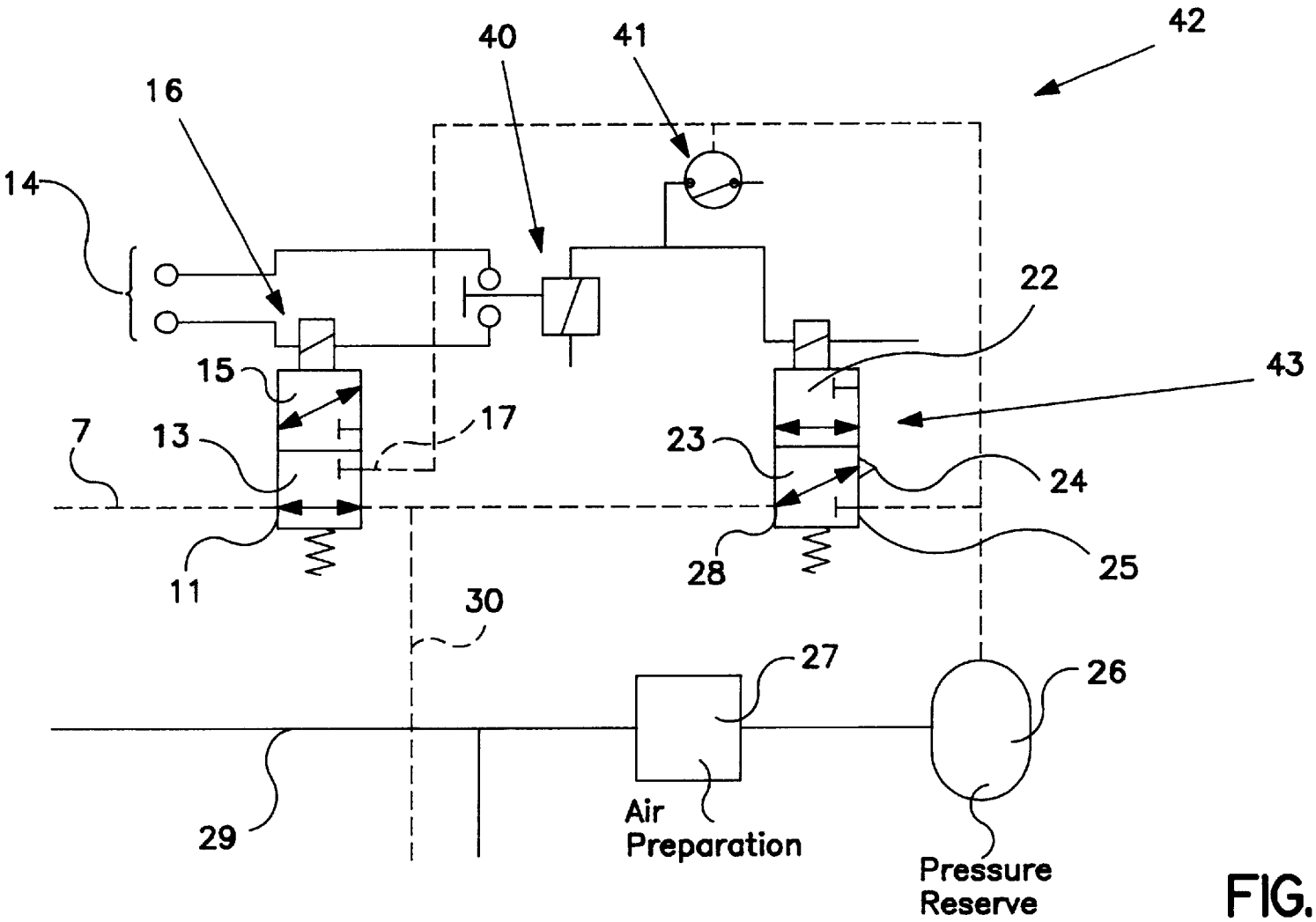
FIG. 2 is a schematic diagram of an alternative control logic that can be used in the installation for the production of pressure of FIG. 1.

FIG. 2 shows a control logic (42) for such an embodiment. While a contour line around the switch valves (16, 21) in FIG. 1 indicates that these are combined into a compact component, the control logic (42) of FIG. 2 is made up of individual valves (16, 43) separated from each other. The outputs (11, 28) of the control logic (42) coincide therefore with the work outputs of the switch valves (16, 43).

The first switch valve with the electrical switching device of the control logic (42) is designated in FIG. 2 by the reference number (43). The control logic (42) also comprises a switch (41) that monitors the pressure of the pressure reserve (26), whereby the point of measuring is the input (25) of the first switch valve (43) or the second input (17) of the second switch valve (16). When the monitored pressure reaches the desired value, the switch (41) closes the electrical circuit of the electrical switching device of the first switch valve (43), which switches to its open position (22) with the consequences described earlier. When the pressure drops to the lower limit value, the electrical switching device of the first switch valve (43) switches this valve back to its closed position (23).

FIG. 2 shows, in addition, a further development of the control logic (42) in the form of an opener relay (normally closed relay) (40) that is controlled by the switch (41). The relay is located in the electrical circuit of the second switch valve (16). When the switch (41) closes, the relay (40) opens the electrical circuit of the switching device of the second switch valve (16). If its switching device is actuated at that moment, this actuation is stopped and the second switch valve (16) is switched back to its first open position (13). In this further development, the control logic (42) cannot transmit the partial load and the idle signals at the same time at its outputs (11 and 28). This means that, in this further development, the control logic (42) can assume only the first, second and third operating states according to the definitions given above.

Commercially obtainable 3/2-way valves can be used as the first switch valve (43) and as the second switch valve (16) according to FIG. 2.

The described control logics (20, 42) only make it possible for the inlet valve (6) to be switched into its idling position (5) independently of the other inlet valve (9). In a manner not described in further detail here, the control logics can, however, also be developed further so that the inlet valves (6, 9) can be switched alternately and independently of each other. Uniform charging of the cylinders (1, 34) and their components can be ensured in this manner.

Several additional possibilities for further developments of the installation for the production of pressure are now explained by means of FIG. 1.

In addition to the previously mentioned switchable inlet valves, additional non-switchable inlet valves (37, 35) can be assigned to one or both compression chambers (2 and 33). This improves the filling of the applicable compression chamber (2 or 33) and thereby the volumetric effectiveness of the installation for the production of pressure. For example, U.S. Pat. No. 5,101,857 describes a further inlet valve, which is formed by non-swiveling and non-sliding valve lamella, that can be used as such additional inlet valves.

It should be mentioned here that the switchable inlet valves (6, 9), the non-switchable inlet valves (37, 35) and the outlet valves (3, 31) can also be representative of several valves having the same function with respect to the applicable compression chamber (2 or 33). In the case of several switchable inlet valves to a compression chamber, the switching of only one of these valves to its idling position is necessary to ascertain the idle operation or the partial delivery operation, respectively, of the installation for the production of pressure. It should also be pointed out that the explanations given above for an installation for the production of pressure with two compression chambers can also apply to installations for the production of pressure with a greater number of compression chambers.

The suction line (10) is often widened to a suction chamber common to both compression chambers (2, 33) or to separate suction chambers for each compression chamber. A common suction chamber is indicated by the reference number (36) and broken lines in FIG. 1. The inlet valves (6, 9 or 35, 37) are often located in the suction chamber (36) or chambers.

While the invention has been described by reference to specific embodiments, this was for purposes of illustration only. Numerous alternative embodiments will be apparent to those skilled in the art and are considered to be within the scope of the invention.

We claim:

1. An installation for the production of pressure in a pressure medium, the installation being switchable between a delivery operation and an idle operation, the installation having at least two compression chambers that are arranged in at least one compressor, each compression chamber being assigned at least one switchable inlet valve, each of said switchable inlet valves having a rest position which allows said pressure medium to flow into the associated compression chamber in said delivery operation of said installation, each of said switchable inlet valves also having an idling position which allows said pressure medium to flow into and out of the associated compression chamber without being substantially compressed in said idle operation of said installation, wherein at least one inlet valve can be switched to its idling position independently of the at least one other inlet valve to switch said installation to a partial delivery operation, at least one of said compression chambers being assigned at least one non-switchable inlet valve.

2. The installation for the production of pressure of claim 1 wherein the at least one independently switchable inlet valve is a second inlet valve and the at least one other switchable inlet valve is a first inlet valve, said installation further comprising a control logic with first and second outputs connected to said first and second switchable inlet valves respectively for controlling the positions of said switchable inlet valves, wherein said control logic produces in a first operating state, no signal at said first and second outputs in said delivery operation, said first and second inlet valves thereby remaining in their rest positions, wherein said control logic produces in a second operating state, an idling signal at both said first and second outputs in said idle operation, thereby switching said first and second inlet valves to their idling positions, and wherein said control logic produces in a third operating state, a partial load signal only at said second output in said partial delivery operation thereby switching only said second inlet valve to its idling position.

3. The installation for the production of pressure of claim 2 wherein said control logic has a fourth operating state wherein in said fourth operating state said control logic produces said idling signal at said first output and said partial load signal at said second output, so that said first and second inlet valves are in their idling positions in said fourth operating state.

4. The installation for the production of pressure of claim 3 wherein said control logic produces said partial load signal depending on at least one parameter occurring upstream of at least one of said first and second inlet valves.

5. The installation for the production of pressure of claim 3 wherein said control logic comprises a first switch valve having an input, a pressure relief output, and a work output, said first switch valve being switchable between an open position and a closed position, wherein said input of said first switch valve is connected to a first pressure reserve, and wherein said work output of said first switch valve is connected to said first output of said control logic, a second switch valve having first and second inputs and a work output, said second switch valve being switchable between first and second open positions, wherein said work output of said second switch valve is connected to said second output of said control logic, wherein said first input of said second switch valve is connected to said work output of said first switch valve, and wherein said second input of said second switch valve is connected to a second pressure reserve, wherein in said open position of said first switch valve, said work output of said first switch valve is connected to said input of said first switch valve, and wherein in said closed position of said first switch valve, said work output of said first switch valve is connected to said pressure relief output of said first switch valve, wherein in said first open position of said second switch valve, said work output of said second switch valve is connected to said first input of said second switch valve and said second input of said second switch valve is closed, and wherein in said second open position of said second switch valve, said work output of said second switch valve is connected to said second input of said second switch valve and said first input of said second switch valve is closed.

6. The installation for the production of pressure of claim 5 wherein said inlet valves are pressure actuated.

7. The installation for the production pressure of claim 6 wherein at least one pressure serves for the production of the signals produced at the outputs of the control logic.

8. The installation for the production of pressure of claim 5 wherein said first and second pressure reserves are the same.

9. The installation for the production of pressure claim 5 wherein said work output of said first switch valve constitutes said first output of said control logic.

10. The installation for the production of pressure of claim 5 wherein said work output of said second switch valve constitutes said second output of said control logic.

11. The installation for the production of pressure of claim 5 wherein said first switch valve is switchable between its open and closed positions in response to an electric signal.

12. The installation for the production of pressure of claim 5 wherein the first switch valve is switchable between its open and closed positions in response to a pressure signal.

13. The installation for the production of pressure of claim 5 wherein said first switch valve is switchable between its open and closed positions in dependence upon the pressure in a pressure consuming system located downstream of said first and second compression chambers.

14. The installation for the production of pressure of claim 5 wherein said second switch valve is switchable between its first and second open positions in response to an electric signal.

15. The installation for the production of pressure of claim 5 wherein said second switch valve is switchable between its first and second open positions in dependence upon a pressure signal.

16. The installation for the production of pressure of claim 2 further comprising a pressure consuming system which receives said pressure medium from said first and second compression chambers, and wherein said control logic produces said partial load signal depending on at least one parameter of said pressure consuming system.

17. The installation for the production of pressure of claim 2 wherein said control logic produces said partial load signal depending on at least one parameter occurring upstream of at least one of said first and second inlet valves.

18. The installation for the production of pressure of claim 2 wherein said control logic produces said partial load signal when the rotational speed of a compressor of said installation exceeds a predetermined limit value.

19. The installation for the production of pressure of claim 2 wherein said control logic produces said partial load signal where the dynamic pressure at a location in said installation or in a pressure consuming system connected to said installation exceeds a predetermined limit value.

20. The installation for the production of pressure of claim 2 wherein said control logic produces said partial load signal when the air moisture content at the output of an air preparation device connected to said installation exceeds a predetermined limit value.

21. The installation for the production of pressure of claim 2 wherein the control logic produces said partial load signal when the pressure in a suction line connected to at least one of said switchable inlet valves exceeds a predetermined limit value.

* * * * *